US005114194A

United States Patent [19]

Toifl et al.

[11] Patent Number: 5,114,194

[45] Date of Patent: May 19, 1992

[54] SAFETY CLOSURE DEVICE FOR APPLIANCES

[76] Inventors: Pamela G. Toifl; Samuel D. Toifl, both of 1847 Pipestone, San Antonio, Tex. 78232

[21] Appl. No.: 657,168

[22] Filed: Feb. 15, 1991

[51] Int. Cl.[5] ..... F05C 3/14

[52] U.S. Cl. ..... 292/106; 292/207; 292/DIG. 71; 292/288; 292/DIG. 28

[58] Field of Search ..... 292/207, DIG. 71, DIG. 65, 292/288, DIG. 28, 297, 298, 295, 106

[56] References Cited

U.S. PATENT DOCUMENTS

| | | | |
|---|---|---|---|
| 2,608,711 | 9/1952 | Moore | 16/82 |
| 2,797,655 | 7/1957 | Morehouse | 292/DIG. 7 |
| 2,879,123 | 3/1959 | Newcomer, Jr. et al. | 292/DIG. 65 |
| 3,069,217 | 12/1962 | Kors | 292/DIG. 65 |
| 3,591,219 | 7/1971 | Graziosi | 292/207 |
| 3,621,684 | 11/1971 | Horvay | 65/6 |
| 3,797,871 | 3/1974 | Morishita | 292/DIG. 65 |
| 3,918,752 | 11/1975 | Leone et al. | 292/DIG. 65 |
| 4,132,440 | 1/1979 | Johnson | 292/DIG. 71 |
| 4,469,358 | 9/1984 | Abbott | 292/288 |
| 4,471,980 | 9/1984 | Hickman | 19/6 |
| 4,648,637 | 3/1987 | Walter | 292/DIG. 71 |
| 4,715,629 | 12/1987 | Robinson | 292/288 |
| 4,763,607 | 8/1988 | Tominaga | 292/DIG. 28 |
| 4,854,448 | 8/1989 | Hair, II | 55/02 |

FOREIGN PATENT DOCUMENTS

| | | | |
|---|---|---|---|
| 934324 | 8/1963 | United Kingdom | 292/DIG. 65 |
| 2083541 | 3/1982 | United Kingdom | 292/DIG. 65 |

*Primary Examiner*—Eric K. Nicholson
*Attorney, Agent, or Firm*—Gunn, Lee & Miller

[57] ABSTRACT

A safety closure device to prevent access by young children to appliances such as refrigerators, freezers, dishwashers and ovens. The safety closure device comprises a mounting means to secure the device to the appliance without damaging said appliance, a blocking means that alternately allows and prevents the door of the appliance from opening, a retention means that holds said blocking means in place and a releasing means that allows the release of said retention means.

3 Claims, 2 Drawing Sheets

SAFETY CLOSURE DEVICE FOR APPLIANCES

BACKGROUND OF THE INVENTION

1. FIELD OF THE INVENTION

This invention relates generally to the field of security closures. Specifically, the present invention provides a device which prevents access by young children to major appliances such as refrigerators, freezers, dishwashers and ovens.

2. DESCRIPTION OF THE PRIOR ART

Modern refrigerators, freezers, dishwashers and ovens typically are designed for easy access by the consumer. This easy access, however, poses a potential hazard to young children. Refrigerators and freezers are hazardous if a child climbs into one and is not able to get out. Refrigerators also contain many breakable items such as raw eggs and glass containers and uncooked food such as raw meats that are potentially hazardous in the hands and mouth of a young child. Dishwashers usually contain breakable and sharp objects such as glasses and knives that can be hazardous in the hands and mouth of a young child. Dishwashers and ovens have interior surfaces and items contained therein that can become extremely hot when in use and thus pose another threat to young children.

Devices for limiting access to such appliances are known in the art. These devices are of limited value since they are rarely used due to inconvenience, damage to the surface of the appliance or inability to attach to the textured doors of new appliances.

U.S. Pat. No. 4,469,358 issued to Abbott discloses a device for securing a refrigerator door although no claims are made for such a device. The device disclosed utilizes two suction cups, one located on the door and the other on the side of the refrigerator. The two suction cups are then connected by a chain which connects to the hooks on the suction cups. Although this device may work on some appliances, the suction cup will not adhere to the textured material frequently used on the doors of appliances today and the device utilizes a fastening means that can easily be unfastened by young children and thereby defeating the primary purpose of the device. Furthermore, if there is any slack in the chain connecting the two suction cups, the suction cups frequently break loose when there is a hard pull on the door.

In summary, no invention is known which provides features for use as a safety closure for appliances and which is easily installed without damage to the appliance and is not readily disengaged by a young child.

SUMMARY OF THE INVENTION

It is, therefore, an object of the present invention to provide a novel safety closure device that can prevent access by young children to major appliances such as refrigerators, freezers, dishwashers and ovens.

It is another object of the present invention to provide a novel safety closure device that can be installed easily without damage to the surface of the appliance to which it is fastened.

It is another object of the present invention to provide a novel safety closure device that young children cannot disengage.

It is another object of the present invention to provide a novel safety closure device that will work on appliances with smooth and with textured doors.

It is another object of the present invention to provide a novel safety closure device that can be easily engaged and disengaged by an adult using only one hand.

It is another object of the present invention to provide a novel safety closure device that can be removed easily for cleaning or when it is no longer required.

In accordance with the above objectives, applicants' invention is a safety closure device that prevents access by young children to appliances such as refrigerators, freezers, dishwashers and ovens. The safety closure device comprises a mounting means that attaches the device to the appliance without damaging the surface of the appliance but still allows easy removal for cleaning or when the device is no longer required, a blocking means which can be positioned alternately to allow the door to be opened and to prevent the door from being opened, a retention means that prevents young children from disengaging the blocking means and a releasing means that allows adults to release the retention means and the blocking means using a single hand. Since the safety closure device is attached only to the top or side of an appliance and not to the door as in the prior art, the safety closure device will work with appliances with textured doors as well as with appliances with smooth doors.

DESCRIPTION OF THE PREFERRED EMBODIMENT

Figure 1:
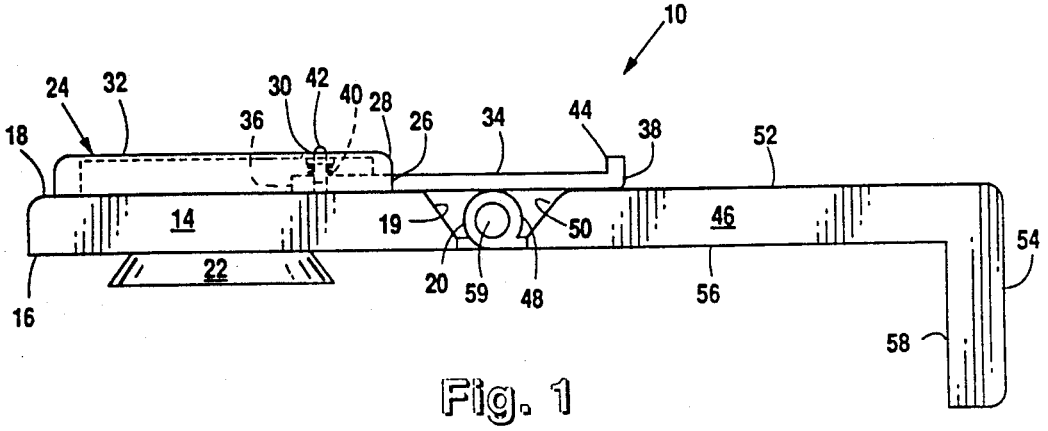
FIG. 1 is a side view of the preferred embodiment of the safety closure device in the blocking position.
Figure 2:
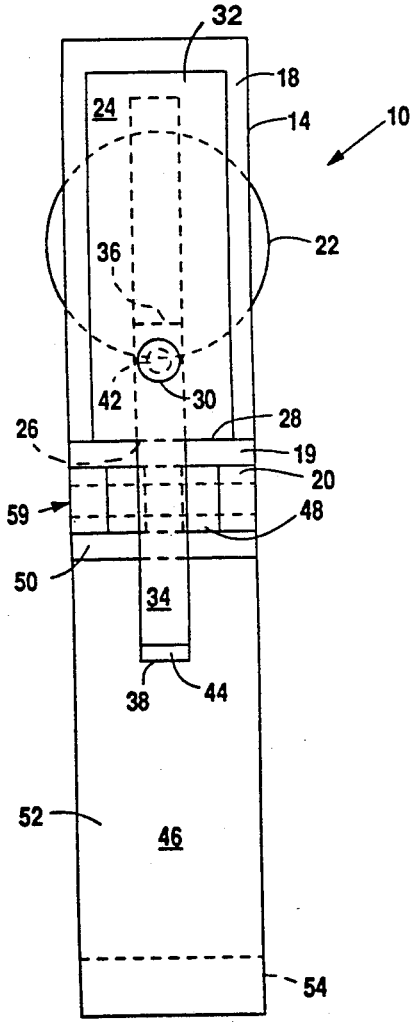
FIG. 2 is a top view of the preferred embodiment of the safety closure device in the blocking position.

FIG. 1 and FIG. 2 illustrate the preferred embodiment of a safety closure device 10 apart from an appliance 12 (see FIG. 3) onto which safety closure device 10 fits. FIG. 1 and FIG. 2 illustrate the side view and top view respectively of safety closure device 10 in its blocking position. As can be seen from FIG. 1 and FIG. 2, safety closure device 10 is comprised of a mounting plate 14 with a bottom surface 16, a top surface 18, a slanted edge 19 and a hinged edge 20. A suction cup 22 is attached to bottom surface 16 of mounting plate 14.

Figure 3:
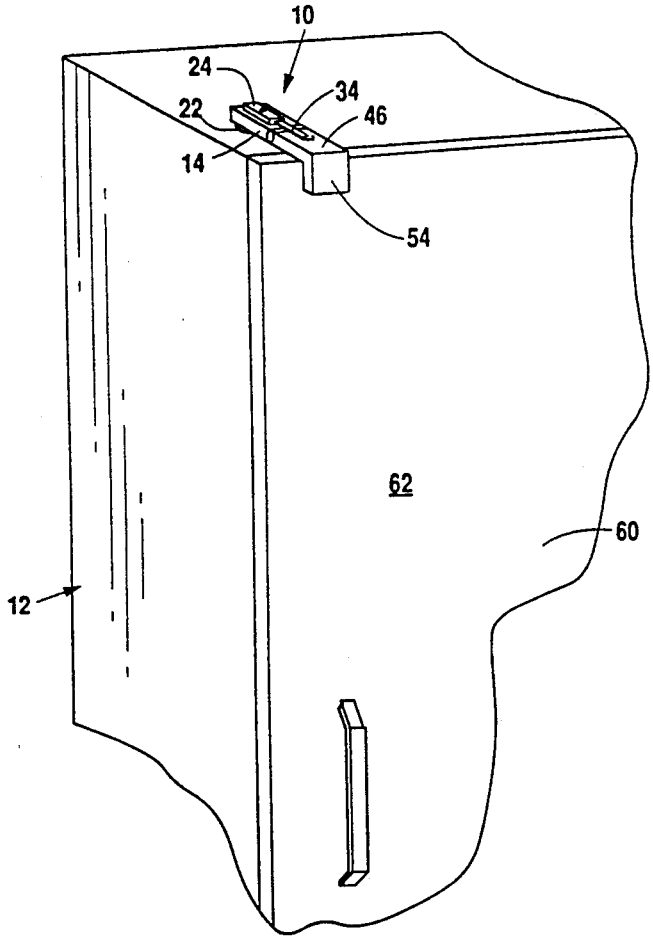
FIG. 3 is a perspective view of the preferred embodiment of the safety closure device mounted on the top of an appliance.

FIG. 3 is a perspective view of the preferred embodiment of safety closure device 10 attached to appliance 12 and in the blocking position. To attach safety closure device 10 to appliance 12, suction cup 22 is moistened and safety closure device 10 is placed into position on appliance 12. Pressure is then applied to safety closure device 10 to depress suction cup 22 against appliance 12 which results in the formation of a vacuum between suction cup 22 and appliance 12, thereby creating adhesive forces which secure suction cup 22 to appliance 12.

Although the preferred embodiment of safety closure device 10, as described above, is attached to the top of appliance 12, safety closure device 10 alternatively may be attached to the side of appliance 10 (not shown).

As shown in FIG. 1 which is a side view of the preferred embodiment of safety closure device 10, a retention bar housing 24 with a rectangular aperture 26 in a slotted end 28 and a circular aperture 30 in a top surface 32 is permanently attached to top surface 18 of mounting plate 14.

A retention bar 34 is positioned through rectangular aperture 26 such that an inner end 36 of retention bar 34 is inside retention bar housing 24 and an outer end 38 of retention bar 34 is outside retention bar housing 24.

A spring 40 connects a push button 42 to inner end 36 of retention bar 34. A lip 44 at outer end 38 of retention bar 34 prevents retention bar 34 from being pushed completely inside retention bar housing 24. When retention bar 34 is fully extended adjacent to and parallel with a blocking arm 46 such that push button 42 is positioned adjacent to circular aperture 30, spring 40 fully extends to its normal position such that push button 42 extends up through circular aperture 30.

Blocking arm 46 is comprised of a hinged edge 48, a slanted edge 50, a top surface 52, a leg 54, a bottom surface 56 and an inner surface 58 and is connected to mounting plate 14 at hinged edge 48 by a hinge pin 59.

To position blocking arm 46 in the blocking position, blocking arm 46 is pivoted away from retention bar housing 24 on hinged edge 48 until bottom surface 56 of blocking arm 46 contacts appliance 12 and inner surface 58 of leg 54 contacts a front surface 60 of a door 62 of appliance 12 (see FIG. 3). In this position, leg 54 blocks door 62 from opening.

FIG. 1 and FIG. 2 illustrate the preferred embodiment of safety closure device 10 in the blocking position showing a side view and top view respectively. To prevent blocking arm 46 from being pivoted away from front surface 60 of door 62 and disengaging safety closure device 10, retention bar 34 is pulled through rectangular aperture 26 in slotted end 28 of retention bar housing 24 until push button 42 is positioned adjacent to circular aperture 30 in retention bar housing 24. Spring 40 then resumes its normal extended position and pushes push button 42 through circular aperture 30. When retention bar 34 is in this blocking position, push button 42 protrudes upward through circular aperture 30 in retention bar housing 24 and prevents blocking arm 46 from being moved.

Figure 4:
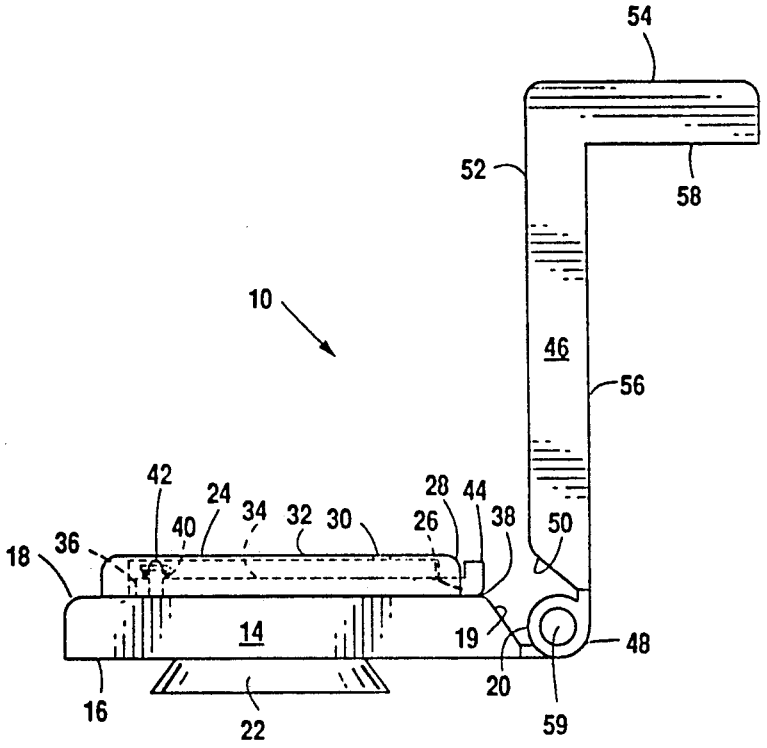
FIG. 4 is a side view of the preferred embodiment of the safety closure device in the open position.

FIG. 4 shows a side view of the preferred embodiment of safety closure device 10 in its open position. To disengage safety closure device 10, push button 42 is depressed through circular aperture 30, thereby compressing spring 40, and concurrently outer end 38 of retention bar 34 is pushed towards retention bar housing 24 such that retention bar 34 retracts through rectangular aperture 30 into retention bar housing 24 until lip 44 of retention bar 34 contacts slotted end 28 of retention bar housing 24. Blocking arm 46 is then pivoted toward retention bar housing 24 on hinged edge 48 until slanted edge 50 of blocking arm 46 contacts slanted edge 19 of mounting plate 14. Door 62 of appliance 12 can now be opened.

To remove safety closure device 10 from appliance 12, the edge of suction cup 22 is lifted to break the vacuum seal thus allowing safety closure device 10 to be removed.

Although the preferred embodiment, as described above, includes retention bar 34 for preventing blocking arm 46 from being moved, the safety closure device may include a different retention means such as a swivel bar (not shown) which is pivotally attached to mounting plate 14. The swivel bar is pivoted in a plane parallel to a plane of top surface 52 of blocking arm 46 between an open position with the swivel bar perpendicular to a plane formed by mounting plate 14 and blocking arm 46 that allows blocking arm 46 to be moved and a closed position with the swivel bar located adjacent to blocking arm 46 and parallel to the plane formed by mounting plate 14 and blocking arm 46 that prevents blocking arm 46 from being moved.

Figure 5:
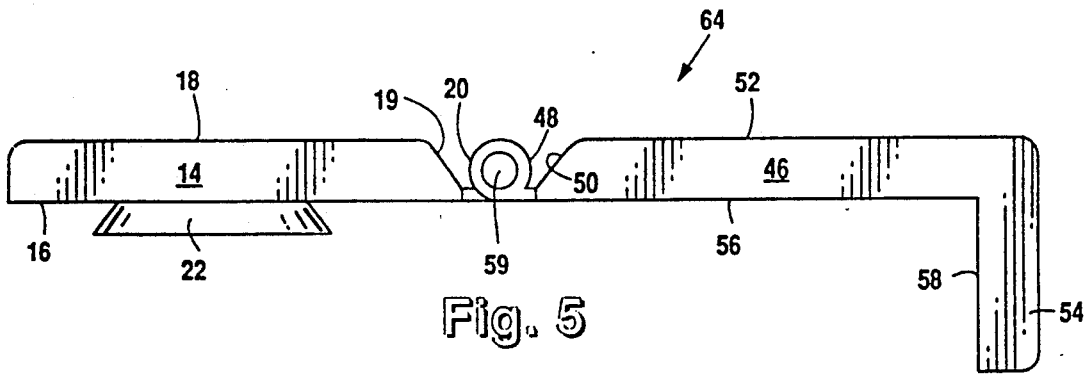
FIG. 5 is a side view of an alternative embodiment of the safety closure device without the retention means.

FIG. 5 shows another embodiment of a safety closure device 64. In this embodiment, safety closure device 64 is mounted to appliance 12 in the same manner as safety closure device 10. Operation of safety closure device 64 is identical to safety closure device 10 except that no retention bar housing 24 (see FIG. 1) and no retention bar 34 (see FIG. 1) are used.

Although the invention has been described with reference to specific embodiments, this description is not meant to be construed in a limited sense. Various modifications of the disclosed embodiments, as well as alternative embodiments of the invention will become apparent to persons skilled in the art upon reference to the description of the invention. It is, therefore, contemplated that the appended claims will cover such modifications that fall within the scope of the invention.

We claim:

1. A safety closure device to prevent young children from independently gaining access into an appliance through a door of said appliance comprising:

a rigid blocking arm for alternately allowing and blocking the opening of said appliance door;

a rigid mounting plate pivotally connected to said blocking arm;

mounting means connected to said mounting plate for removably attaching said safety closure device to said appliance; and a retention bar for alternately allowing and preventing the movement of said blocking arm from a blocking position to an open position, said retention bar being movably attached to said mounting plate and positioned so as to be alternately adjacent to and removed from said blocking arm:

a retention bar housing attached to said mounting plate, said retention.

2. The invention of claim 1 further comprising:

a retention bar housing attached to said mounting plate, said retention bar housing having an end that defines an aperture that allows said retention bar to be retracted into said retention bar housing so as to remove said retention bar from a position adjacent said blocking arm and to thereby allow said blocking arm to be moved, said retention bar housing further having a top surface that defines a circular aperture; and spring-mounted push button attached to said retention bar so as to protrude through said circular aperture in said top surface of said retention bar housing when said retention bar is fully extended adjacent to and parallel with said blocking arm, and prevent said retention bar from being moved from a position adjacent to said blocking arm to a position removed from said blocking arm until said push button is depressed through and removed from said circular aperture.

3. A safety closure device to prevent young children from independently gaining access into an appliance through a door of said appliance comprising:

a rigid blocking arm for alternately allowing and blocking the opening of said appliance door;

a rigid mounting plate pivotally connected to said blocking arm;

mounting means connected to said mounting plate for removably attaching said safety closure device to said appliance;

a retention bar for alternately allowing and preventing the movement of said blocking arm from a blocking position to an open position, said retention bar being movably attached to said mounting plate and positioned so as to be alternately adjacent to and removed from said blocking arm;

a retention bar housing attached to said mounting plate, said retention bar housing having an end that defines an aperture that allows said retention bar to be retracted into said retention bar housing so as to remove said retention bar from a position adjacent said blocking arm and to thereby allow said blocking arm to be moved, said retention bar housing further having a top surface that defines a circular aperture; and a spring-mounted push button attached to said retention bar so as to protrude through said circular aperture in said top surface of said retention bar housing when said retention bar is fully extended adjacent to and parallel with said blocking arm, and prevent said retention bar from being moved from a position adjacent to said blocking arm to a position removed from said blocking arm until said push button is depressed through and removed from said circular aperture.

* * * * *